United States Patent [19]

Anderson et al.

[11] Patent Number: 5,014,972

[45] Date of Patent: May 14, 1991

[54] RECIRCULATING AUTOMATIC DOCUMENT FEEDER

[75] Inventors: Carl P. Anderson, San Mateo County, Calif.; Edward E. Mayer, Middlesex County, Conn.

[73] Assignees: Ricoh Company Ltd., Japan; Ricoh Corporation, San Jose, Calif.

[21] Appl. No.: 315,174

[22] Filed: Feb. 24, 1989

Related U.S. Application Data

[63] Continuation of Ser. No. 26,286, Mar. 16, 1987, abandoned, which is a continuation-in-part of Ser. No. 803,649, Dec. 2, 1985, Pat. No. 4,703,923.

[51] Int. Cl.[5] ..... B65H 5/22

[52] U.S. Cl. ..... 271/3.1; 271/94; 271/161; 271/240

[58] Field of Search ..... 271/3.1, 161, 188, 209, 271/94, 180, 221, 212, 240

[56] References Cited

U.S. PATENT DOCUMENTS

| | | | |
|---|---|---|---|
| 2,027,341 | 1/1936 | Hornbeck et al. | 271/221 |
| 3,761,080 | 9/1973 | Larson | 271/209 |
| 4,346,882 | 8/1982 | Pessina et al. | 271/221 |
| 4,353,542 | 10/1982 | Knight et al. | 271/209 X |
| 4,413,901 | 11/1983 | Kollar | 271/3.1 X |
| 4,451,028 | 5/1984 | Holmes et al. | 271/34 X |
| 4,703,923 | 11/1987 | Anderson et al. | 271/3.1 |

FOREIGN PATENT DOCUMENTS

| | | | |
|---|---|---|---|
| 613771 | 5/1935 | Fed. Rep. of Germany | 271/75 |

*Primary Examiner*—H. Grant Skaggs
*Attorney, Agent, or Firm*—Flehr, Hohbach, Test, Albritton & Herbert

[57] ABSTRACT

In an electrophotographic copying apparatus, the document stack to be fed is curved when it rests on a fixed curved stack-holding tray. The document stack is lifted by a pair of lifting blades having the curvature of the stack which move horizontally relative to the ends of the stack to move in and out beneath the sides of the stack, and thereafter move vertically to lift the entire stack out of the path of the returning copy. A vacuum belt arrangement is provided for moving successive documents from the top of the stack into the electrophotographic copying machine. The document loops through the machine and returns at a lower level, aligned with an opening beneath the bottom of the stack. Moving belts running beneath the stack carry the returning document into alignment under the stack. Once the document is returned, the lifting blades move vertically downward and laterally outward, resting the remainder of the document stack on the returned document, making it a part of the stack; when the lifting blades again perform their cyclic motion, they again move under the bottom edges of the stack and lift the stack, including the returned document. The blades are carried on vertical side supports. When a sheet is being returned to the stack, at least one vertical lifting blade side support is held a short distance from the side of the stack. When the stack is to be lowered, the vertical support is first moved in toward the stack so that the bottom, returned sheet is aligned with the rest of the stack. The stack is then lowered onto the returned sheet. Knife edge elements are provided movable between the belts which return the sheets to the bottom of the stack. These knife edges are normally lowered; they rise between the belts to lift the returned sheet up under the bottom of the stack.

17 Claims, 5 Drawing Sheets

RECIRCULATING AUTOMATIC DOCUMENT FEEDER

This is a continuation of application Ser. No. 026,286 filed Mar. 16, 1987, now abandoned.

CROSS-REFERENCE TO RELATED APPLICATION

Ser. No. 026,286 is a continuation in part of U.S. application Ser. No. 803,649 field Dec. 2, 1985, now U.S. Pat. No. 4,703,923 in the name of Carl P. Anderson. The apparatus is useful in a photocopying apparatus of the type disclosed in U.S. Pat. No. 4,384,784, incorporated herein by reference.

FIELD OF THE INVENTION

This invention relates generally to an electrophotographic copying apparatus and more particularly to one designed to make copies of a stack of documents automatically. This particular apparatus uses a feeding arrangement configured to act on the stack in a way which successively moves each document of the stack from the top of the stack through the copying apparatus and thereafter back to the bottom of the stack.

BACKGROUND OF THE INVENTION

It is desirable to be able to feed an entire stack of documents one at a time through a copying machine without hand-feeding, and to have each document returned to the bottom of the stack, so that when the stack has been completely copied, it is in its original order when the stack of documents is removed from the machine. Further, separate trays are not needed to receive the original documents to be copied and those which have been copied, minimizing the overall size of the machine.

It is therefore an objective of this invention to provide an improved recirculating automatic document feeder. More particularly, an objective herein is to provide an automatic document feeder feeding each document in turn from the top of the stack, along a path through the copy machine and returning the document in its original orientation to the bottom of the stack.

A major problem in the design of such a system is that in order to return each copied document to the bottom of the stack, the stack must somehow be lifted once during each copy cycle, after the copy is made, so that the returning document may slide into its place underneath the stack of documents, properly aligned with the complete stack.

It is therefore an objective herein to provide a recirculating document feeder that lifts the stack to be copied by the edge in a timely, sequential fashion so that each returning document slides into its place at the bottom of the document stack, and the stack is then returned to rest on the returned document; in this way, upon completion of the next copy cycle, the complete stack may again be lifted out of the returning document's path.

One problem in such a design is that if the copier and the paper stacker are not perfectly aligned as the sheet moves under the stack, the sheet being returned to the bottom of the stack remains misaligned with the stack. A misaligned sheet may also drag against one side of the frame defining the sides of the paper stack. In this case, the paper will not slide or carry all the way forward to the front paper stop. In fact, the paper will probably skew to one side as it moves under the stack, interfering with the next following paper and clogging the paper return path.

Simply making the entry channel for the paper wider will not solve the problem; the result would be a decrease in the positional accuracy of the stack. An objective herein is to provide means and method for properly aligning each returning piece of paper with the existing stack.

SUMMARY OF THE INVENTION

As discussed, and as will be seen in more detail, the recirculating automatic document feeder of this invention is especially designed for use in an electrophotographic apparatus which includes the present arrangement configured to act on the stack in a way which successively moves each document onto a copying platen from the top of the stack when the stack is placed in a feed tray, forming part of the arrangement, and thereafter returning the document to the bottom of the stack properly aligned with the stack along a looped path of movement from the tray to platen and back to tray. Specific details of the components of the electrophotographic apparatus, including the copying platen, may be found in U.S. Pat. No. 4,384,784 assigned to the Assignee of this invention, incorporated herein by reference.

This invention is especially useful for continuously removing sheets from the top of and returning sheets to the bottom of a document stack which is bent or curved when it rests on a fixed curved stack-holding tray. The reason for providing this curved stacking tray is that a stack of paper becomes rigid when curved, and therefore, capable of being raised by applying an upward force along the curved edges of the stack. In order to provide this edge-lifting force which can be used to raise the stack off the curved tray, a pair of curved lifting blades having the same curvature as the stack are provided. These blades move horizontally relative to the edges of the stack to move in beneath the edges of the stack, and thereafter move vertically to lift the entire stack out of the path of the returning copy. The document to be copied may be lifted off the top of the document stack either before or after the lifting action of the lifting blades.

Preferably, a vacuum belt arrangement is provided for moving successive documents from the top of the stack into the electrophotographic copying machine. The document loops through the machine and returns at a lower level, aligned with an opening beneath the bottom of the stack. A levered plate is provided at the forward lateral edge of the stack to be sure the edges of the raised stack are lifted out of the return paper document path. Moving belts running beneath the stack carry the returning document into alignment under the stack. A metal plate running horizontally or laterally along the edge of the stack, perpendicular and very close to the belts acts as a stop to stop the returning document in alignment with the document stack being fed.

Once the document is returned, the lifting blades move vertically downward, and then laterally outward from beneath the stack, resting the remainder of the document stack on the returned document, making it a part of the stack and completing the paper circulation cycle. When the lifting blades again perform their cyclic motion, they again move under the bottom edges of the stack and lift the stack, including the returned document.

The blades are carried on vertical side supports. It is especially important that these side supports be positioned so that the returning document can pass between the side supports. In a preferred embodiment disclosed in this continuation-in-part application, when a sheet is being returned to the stack, both side supports are held 1/16 to 1/8 from the side of the stack so that the returning sheet does not strike or drag against either side support. When the stack is lowered, the vertical supports are first moved in toward the stack so the bottom, returned sheet is aligned with the stack. The stack is then lowered onto the returned sheet.

In a further alternative and preferred mode disclosed in this preferred embodiment, knife edge elements are provided movable between the belts which return the sheets to the bottom of the stack. These knife edge elements are normally lowered; they rise between the belts to lift the returned sheet up under the bottom of the stack.

BRIEF DESCRIPTION OF THE DRAWINGS

The overall circulating automatic document feeder of this invention will be described in more detail hereinafter in conjunction with the drawings wherein.

DETAILED DESCRIPTION OF A PREFERRED EMBODIMENT

Figure 1:
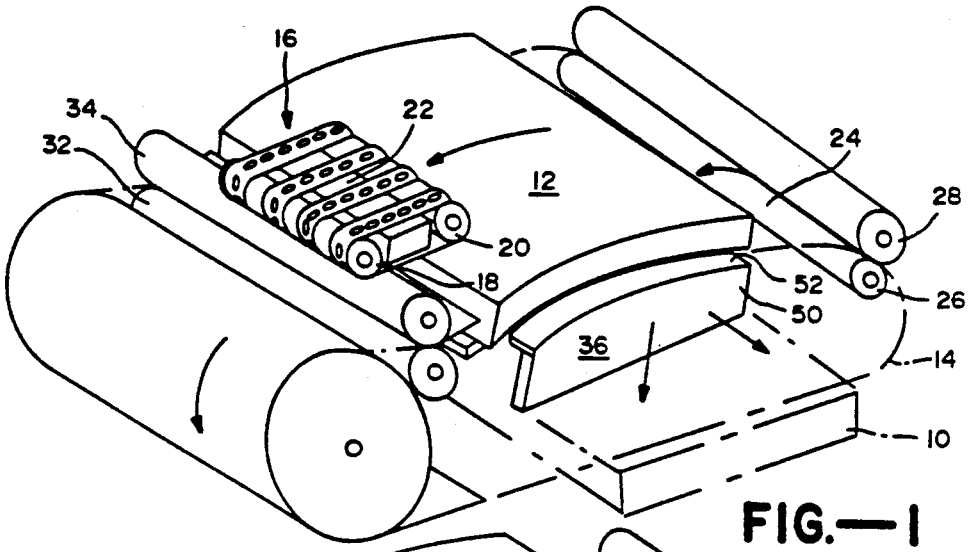
FIGS. 1 and 2 are perspective views of the recirculating document feeder of this invention showing many of its essential elements, and the circulation path of the documents.
Figure 2:
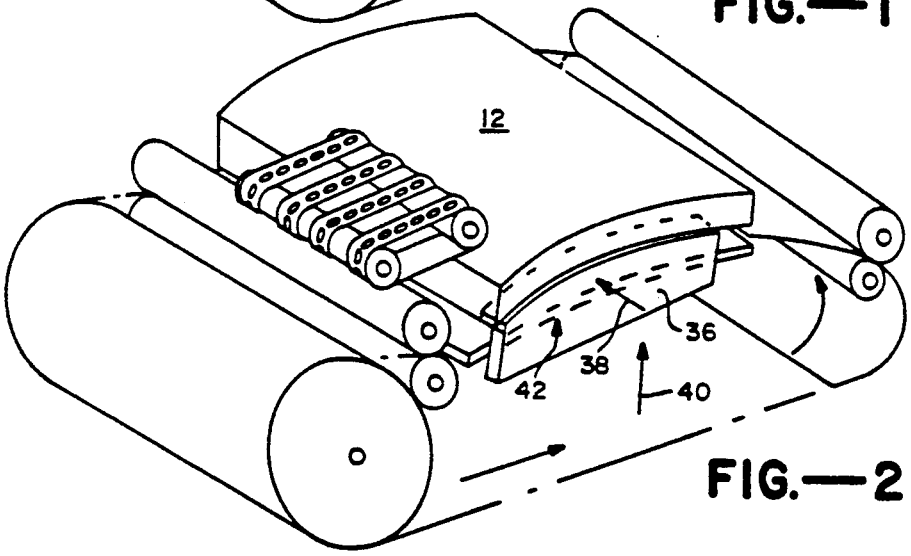

Turning now to the drawings, wherein like components are designated by like reference numbers throughout the figures, attention is first directed to FIGS. 1 and 2 which illustrate the overall structure of the recirculating automatic document feeder of this invention, it is typically used in conjunction with an electrophotographic copying apparatus generally indicated by reference number 10, although it is adaptable to other uses requiring a recirculating document feeding system.

The document feeding arrangement is designed to automatically feed one document at a time lifted from the top of a stack of documents 12 along a path 14 in the direction of the arrows. The top document pick-off is achieved using a plurality of vacuum type belts generally indicated at 16 rotating about a pair of rollers 18, 20. A vacuum source 22 picks off the top sheet of the stack documents 24 and feeds it through feed rollers 32, 24 toward the copying apparatus 10. The copied document circulates along the path 14, returning through an exit roller and transfer rollers 26, 28 which are a part of the copying machine, to be placed at the bottom of the stack from which the document was withdrawn.

As shown in FIG. 1, the top document may be picked off when the lifting blades 36 are lowered and moved outward from the bottom of the document stack so that the stack is not elevated, or when the stack 12 is in a raised position so that a sheet can be returned to the bottom. This dual position vacuum pick-off is achieved simply by allowing the vacuum pick-off 16 to rotate around the axis of support roller 18 so that the pick-off roller 16 always rests on the top of the stack. Thus, the document can be as easily removed when the stack is in its lifted position as when the stack is lowered. The position of the document stack 12 when the top document is being removed must be taken into account, due to the fact that greater pressure will exist between the vacuum feed rollers 16 and the top sheet 24 which is to be removed. This can be done with a simple microswitch arrangement attached to vacuum device 16.

Figure 5:
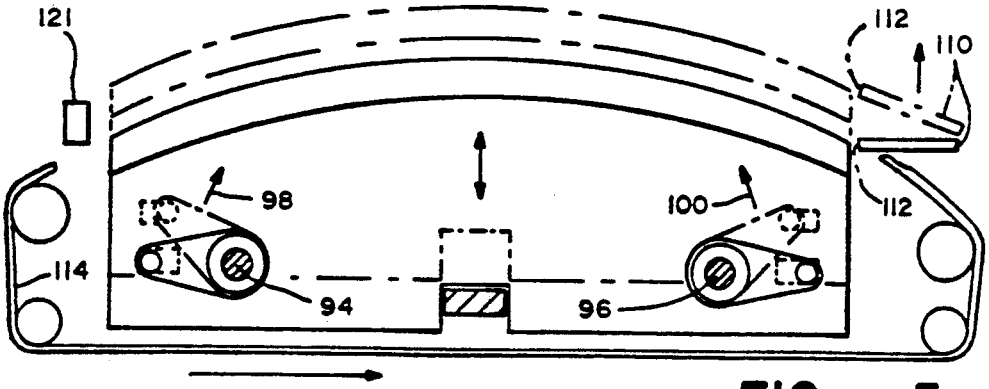
FIG. 5 is a vertical elevation view of the lifting rods which lift the blades and thereby the edges of the stack as well as lifting a plate which clears a path for the return of the documents.
Figure 3:
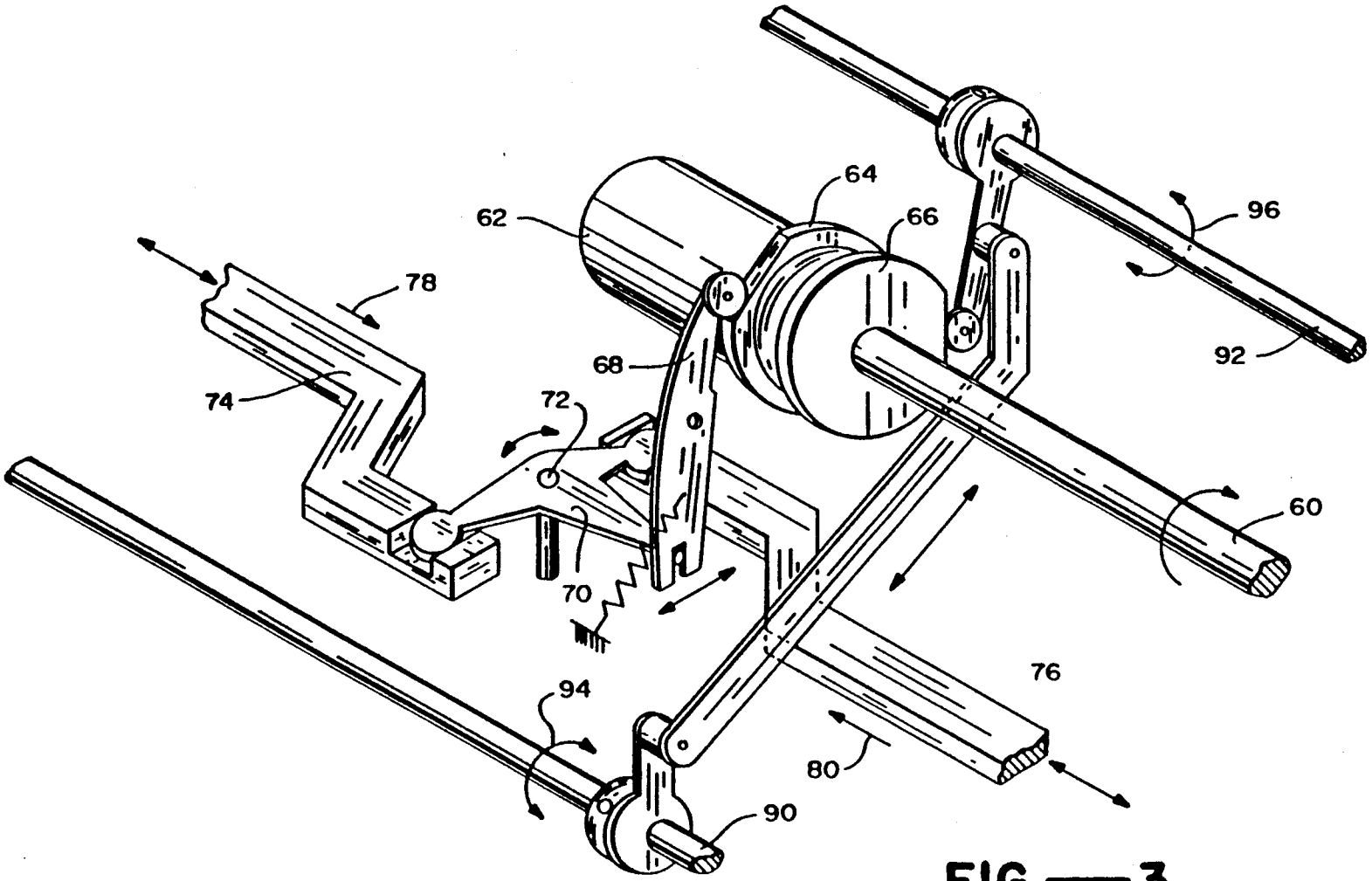
FIG. 3A shows the camming arrangement which controls the timing of the lateral and vertical motion of the lifting blades, as well as the plate which clears a path for the return of the document.
FIG. 3B is a side view of cam 64', with dotted lines shown to illustrate the three different curvatures of the cam 64'.
Figure 4:
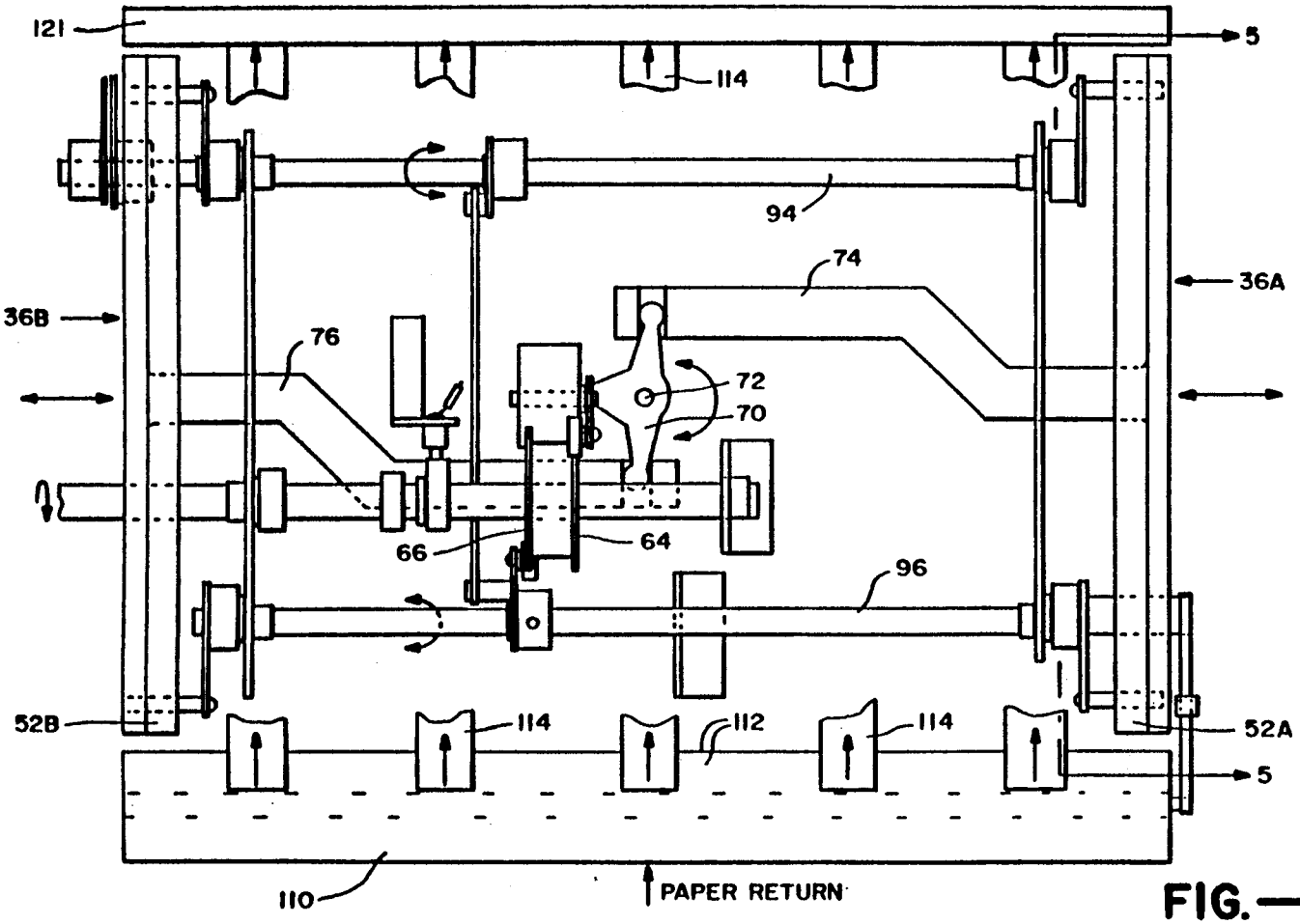
FIG. 4 is a horizontal plane view of essential mechanical elements of this invention including many of the elements of FIG. 3 which carry out the lateral and vertical movement of the lifting blades of this invention.

To achieve the lifting of the stack, the lifting blade 36 (and its hidden coordinated lifting blade on the other end of the stack, not shown) is moved first inward in the direction of arrow 38 and then upward in the direction of arrow 40 utilizing a mechanism to be shown in detail in FIGS. 3—5.

The horizontal movement 38 of the curved lifting blades and vertical movement 40 of the blades lifting the curved stack above the curved tray 42 are necessary to clear the return path of the document.

It can be seen, especially in FIG. 1, that the lifting of the documents is accomplished using a pair of lifting blades 36, one on either side of the document stack 12. One of the blades 36 is shown clearly in FIG. 1; the other blade is hidden behind the stack 12. The blades each comprise a vertical plate 42 for aligning the edges of the document stack 12 and a curved shoulder panel 52 on which the stack 12 rests. The shoulder panes 52 are curved about a horizontal axis located below the stack and oriented transversely to the removing and returning movement of the documents. The blades are positioned in a manner described with reference to FIGS. 6A—6E to lift the document stack along its shorter edges, or width.

It is important to note that the top surface of shoulder panel 52A, 52B of the blades 36 is curved to provide or maintain a curvature in the paper stack. This curvature, having a radius about a horizontal axis located below the stack and oriented transversely to the removing and returning movement of the documents allows the entire stack of paper 12 to be lifted only by its edges. The edges of the curved stack 12 rest on the curved shoulder panels 52 adjacent lifting plates 42 as the plates raise the stack. This movement clears the paper return path.

In a preferred embodiment, each lifting blade 36 comprises a side panel plate 42 and a shoulder panel 52 (see FIG 4 where the two shoulder panels are labelled 52A, 52B as they are of symmetrical construction). As shown in FIGs 1 and 2, the lifting blades 36 are first moved inwardly toward the stack of paper, in the direction of arrow 38; this carries the shoulder panels 52A, B beneath the paper stack 12. The blades 36 are then lifted in the direction of arrow 40 raising the paper stack 12 off the bed, so a returning document may slide beneath the stack. The top document is picked off the stack by picker 16, copied, and returned to the bottom of the stack. The sequence of movements of the lifting blades 36 is then reversed, so that the stack 12 is first lowered onto the bed, and the lifting blades 36 are then withdrawn.

This sequence of motion is controlled by means coupled to move lifting blades 36 as shown in FIGS. 3 and 4 and comprising a rotating shaft 60 which is engaged using clutch 62 to rotate a pair of cams 64, 66. Rotation of the cam 64 by a lever 68 causes movement of the double-armed transfer device 70 about a pivot 72 to pull both levers 74, 76 inward along the arrows 78, 80. These levers are attached (as shown in FIG. 4) to the lifting blades 36A, 36B; the blades move in toward the stack of paper so that shoulders 52A, 52B now rest under the edges of the stack. Lifting of the stack is now accomplished by the rotation of cam 66 which causes rotation of both rods 90, 92, the rods rotating in opposite directions as shown by arrows 94, 96. Rotation of these causes a lifting motion of the end of the blades 36 because of the coupling between the end of these rods and the ends of the lifting blade 36 which is illustrated in FIG 5. The counter rotation of these two rods causes them both to move up in the direction of arrows 98, 100, lifting the lifting blades 36 and the paper along with them.

It should be noted, as shown in FIG. 4, that a metal plate 110 is provided at the side of the device where the paper returns; the plate's edge 112 is notched to ordinarily let the belts 114 which carry the returning document pass through. The edge 112 of the plate (i.e., the downstream edge relative to the returning document) is moved inward and upward (see FIG. 5 which schematically illustrates lifting of the rear edge of the paper stacks) so that the returning paper document which is riding on the moving belts may easily pass under this plate 110 and the paper stack 52 on the belts. The plate 110 serves to lift edges of the stack 52 of documents being copied so they do not interfere with the return of the paper. A second plate 121 is provided, located barely over the top surface of the belts 114 at the other side of the document stack extending down into the document space to serve as a paper stop, so that the returning paper butts up against plate 121 and ends in alignment under the document stack. The belts may be controlled by a switch to only run intermittently when the blades have lifted the paper stack; alternatively, the belts may be of a material to slide beneath the stack when the blades are not lifting the stack, since little force is necessary to forward the single returning document into the stack.

Figure 6A:
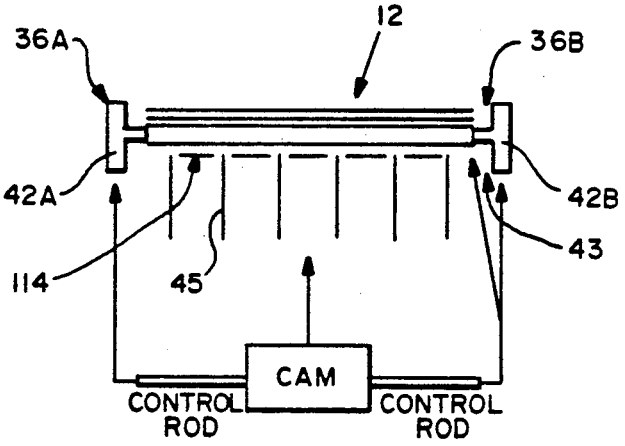
FIGS. 6A—6E illustrate successive steps employing an alterative embodiment of the document feeder wherein the stack of paper is raised to allow return of a sheet of paper to the bottom of the stack (FIGS. 6A, 6B) and then the stack is lowered onto the returned sheet (FIGS. 6C, 6D, 6E).
Figure 6B:
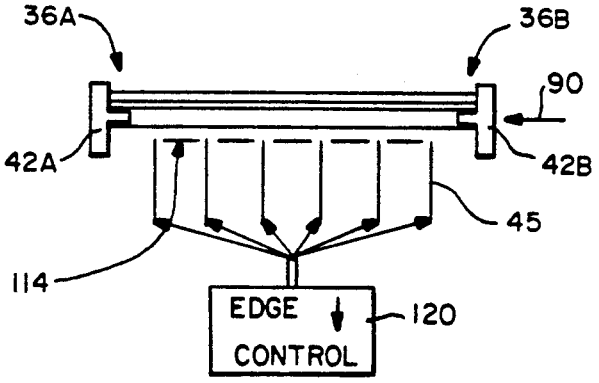

The embodiment described above may be modified as shown in FIG. 6 in which an alternative embodiment is shown having T-shaped lifting blades 36A, B and knife edges 45 with edge control means 120. In FIG. 6B, for example, plates 42A, B are close beside the gap into which the document must return; therefore, any misalignment causes the returning document to contact a plate causing it to skew and not reach the stop at the leading edge of the stack. To overcome this problem, the cam and drive rod arrangement which controls the spacing of the plates 42 may be slightly modified to hold blades 36A, B and thereby plates 42A, B out from the sides of the stack when the document is returning. The modification is illustrated in the sequence of FIG. 6A—6E; the sequence is controlled by means coupled to move the lifting blades that may utilize, for example, a conventional two surface or two step cam instead of the control cam illustrated in detail in FIGS. 3—5.

Figure 6C:
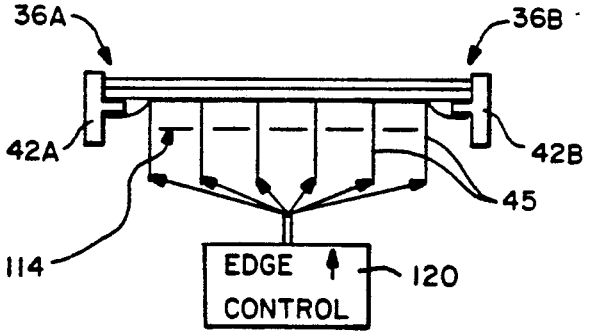
Figure 6D:
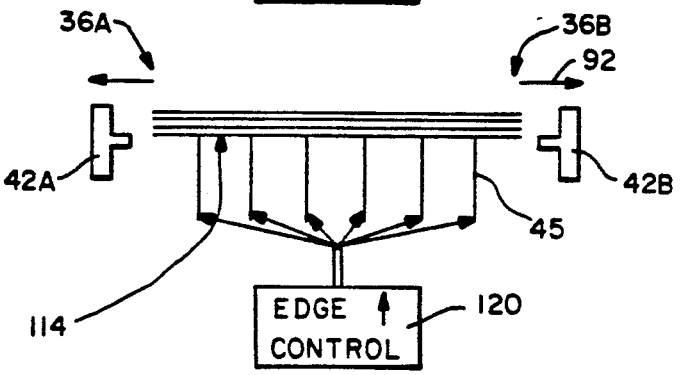
Figure 6E:
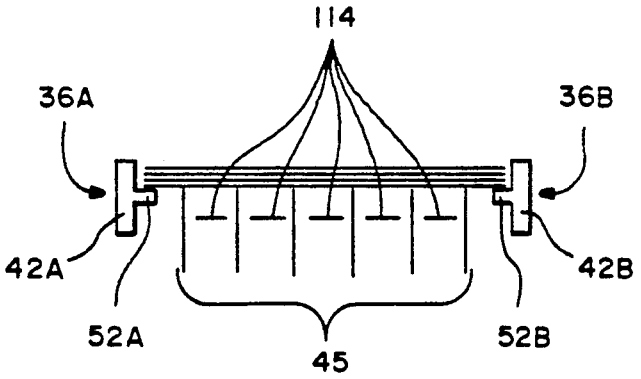

As in FIG. 6D, the blades 36A, B are then withdrawn, allowing the stack to rest in place. Thus the timed sequence involves three steps rather than two moving the blades to the position shown in FIG. 6A) to position them under the stack; lifting the stack; returning the document to the bottom of the stack; closing the gap; then lowering the stack onto the returned document.

These two stages of movement of the blades toward the paper stack may be added to only a single blade; however, this would increase the possibility that a sheet that had moved around the path in good alignment might drag on one of the lifting blades and halt.

In another alternative for further clearance between the belts and the bottom of the stack, it is also possible to provide a set of lifts which essentially comprise knife edges 45 that arise between the moving belts 114. The same control cam which controls the position of the blades 36 can be used to control the position of the knife edge elements 45. In FIG. 6A, the edges 45 are retracted below the belts, so the document may be carried below the stack. The edges 45 remain down until the document has returned as shown in FIG. 6B; the blades 36 are then moved by control means 120 against the sides of the stack 12 in the direction of arrow 90 to properly align all the paper documents. At this point, as shown in FIG. 6C, the knife edges 45 may be lifted, rising between the belts to raise the returned document up against the bottom of the stack, joining the document stack above the surface of the belt so that the belts do not interfere in any way with the stack lying at rest (FIG. 6D). The blades 36A, B are then withdrawn from the sides of the stack in the direction of arrow 92, leaving the stack at rest on knife edges 45. Then support 42A and B move back in part way (FIG. 6E) maintaining gap 43 ready for the next returning sheet.

This change, holding one support plate out a short distance from the side of t e stack and moving back in just before the returned document is lifted or pressed against the bottom of the stack improves the positional accuracy of the system and provides for lateral alignment tolerance, improving the overall operation of the system.

It should be noted that this invention and especially the sequence of operation shown in FIGS. 6A-6D is especially useful in stacking output copies from either a copier or printer, the copies being inserted one at a time at the bottom of the stack.

Alternatives to the implementation of this invention may become apparent to a person of skill in the art who studies the above disclosure. Therefore, the scope of this invention is to be limited only by the following claims.

What is claimed:

1. Electrophotographic copying apparatus including means for successively feeding a stack of documents through said copying apparatus by successively moving each document from the top of said stack through said copying apparatus and thereafter returning each document to the bottom of said stack, the documents in said stack having a defined minimum width and a length, said copying apparatus comprising:

means for periodically raising and lowering said stack relative to a resting position of said stack and including a pair of lifting blades each having upright plate portions and shoulder blade panels carried on said plate portions, said lifting blades being movable from a first position at which said shoulder blade panels are spaced from and outside the edges of said stack, to a second position at which said shoulder blade panels are beneath the edges of the stack and at least one of said upright plate portions is spaced from the edges of said stack to lift the documents from said resting position, means for removing the top document from said stack in a direction along the length of said stack, means for returning the removed top document to the bottom of said stack in the same orientation in which it was removed, and means coupled to move said lifting blades during removal and return of the removed top document, said means coupled to move said lifting blades, moving said lifting blades from said first position to said second position, and after return of the removed top document beneath the stack, said means coupled to move said lifting blades further moving said plate portions to a third position immediately adjacent the edges of said stack to align the removed top document with said stack while positioned beneath said stack.

2. Apparatus as defined in claim 1, and a curved document tray on which the bottom of said stack rests to impart a curvature to said stack, said lifting blades being curved with a curvature about a horizontal axis oriented transversely to the removing and returning movement of the documents.

3. Apparatus as defined in claim 2 wherein, said means coupled to move said lifting blades includes means for periodically moving said lifting blades to said second position to facilitate withdrawal of said top document, and means lifting said stack from said second position to allow return of said top document, and means moving said plate portions outwardly of the minimum stack width to said first position to rest the stack on the returned top document.

4. Apparatus as defined in claim 3 wherein, said shoulder blade panels are curved about a horizontal axis located below the stack and oriented transversely to the removing and returning movement of the documents.

5. Apparatus as defined in claim 4 wherein, said means for removing said top document being positioned in contact with said top document when said stack is lifted to remove said top document from said stack.

6. Apparatus as defined in claim 5 wherein, said means for removing said top document includes a belt rotating about an axis parallel to the axis of a curved upper surface of said stack.

7. Apparatus as defined in claim 6 wherein, said belt is a vacuum belt having openings in said vacuum belt communicating vacuum in said vacuum belt to said top document of said stack to pick aid top document off said stack.

8. Apparatus as defined in claim 1 wherein means for returning the top document includes a plurality of belts running beneath said document stack for carrying the removed top document beneath the stack and including a plurality of lifting edges normally lowered below the surface of said belts to allow said belts to return said document to the bottom of said stack, and edge control means for lifting said edges above the level of said belts to raise said returned document against the bottom of the stack.

9. Apparatus as in claim 8 wherein said edge control means are operative to lift said edges before said lifting blades are withdrawn from the edges of the document stack.

10. Apparatus as defined in claim 9 wherein, said belts are continuously running.

11. Apparatus as defined in claim 9 wherein, said means coupled to move said lifting blades includes means for periodically moving said lifting blades to said second position to facilitate withdrawal of said top document, and means lifting said stack from said second position to allow return of said top document, and means moving said plate portions outwardly of the minimum stack width to said first position to rest said stack on the returned top document.

12. Apparatus as defined in claim 11, and a curved document tray on which the bottom of said stack rests to impart a curvature to said stack, said lifting blades being curved with a curvature about a horizontal axis oriented transversely to the removing and returning movement of the documents.

13. Apparatus as defined in claim 12, wherein, said shoulder blade panels are curved about a horizontal axis oriented transversely to the removing and returning movement of the documents.

14. Apparatus as defined in claim 13 wherein, means for removing the top document is in contact with said top document when said stack is lifted from said resting position to remove the top document from the stack.

15. Apparatus as defined in claim 14 wherein, said means for removing the top document includes a belt rotating about an axis parallel to the axis of a curved upper surface of said stack.

16. Apparatus as defined in claim 1 is wherein, said belt is a vacuum belt having openings in said vacuum belt communicating vacuum in said vacuum belt to said top document of said stack to pick said top document off said stack.

17. Apparatus as in claim 2 or 13 wherein said axis is located below the stack.

* * * * *

UNITED STATES PATENT AND TRADEMARK OFFICE

CERTIFICATE OF CORRECTION

PATENT NO. : 5,014,972

DATED : May 14, 1991

INVENTOR(S) : Carl P. Anderson and Edward E. Mayer

It is certified that error appears in the above-identified patent and that said Letters Patent is hereby corrected as shown below:

Column 3, Line 29, change "FIG. 3A" to --FIG. 3--.

Column 3, Line 33, delete "FIG. 3B is a side view of cam 64', with dotted lines shown to illustrate the three different curvatures of the cam 64'."

Column 5, Line 29, after "plate's" insert --rear--.

Column 5, Line 35, change "stacks)" to --stack)--.

Signed and Sealed this

Thirteenth Day of April, 1993

*Attest:*

STEPHEN G. KUNIN

*Attesting Officer*

*Acting Commissioner of Patents and Trademarks*